US006935895B2

(12) United States Patent
Fan

(10) Patent No.: US 6,935,895 B2
(45) Date of Patent: Aug. 30, 2005

(54) ELECTRICAL CONNECTOR HAVING RETENTION SYSTEM

(75) Inventor: Chia-Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/434,703

(22) Filed: May 8, 2003

(65) Prior Publication Data

US 2004/0198093 A1 Oct. 7, 2004

(30) Foreign Application Priority Data

Apr. 4, 2003 (CN) ..... 92205313 U

(51) Int. Cl.[7] ..... H01R 13/648
(52) U.S. Cl. ..... 439/607
(58) Field of Search ..... 439/620, 79, 607, 439/570, 573

(56) References Cited

U.S. PATENT DOCUMENTS 5,087,212 A * 2/1992 Hanami ..... 439/620
5,125,853 A * 6/1992 Hashiguchi ..... 439/607
5,186,654 A * 2/1993 Enomoto et al. ..... 439/570
5,228,873 A 7/1993 Hirai
5,249,983 A 10/1993 Hirai
6,293,823 B1 * 9/2001 Kasuga ..... 439/573
6,454,575 B1 * 9/2002 Jones et al. ..... 439/79

FOREIGN PATENT DOCUMENTS

TW 517885 1/2003

* cited by examiner

*Primary Examiner*—Phuong Dinh
(74) *Attorney, Agent, or Firm*—Wei Te Chung

(57) ABSTRACT

An electrical connector (1) includes an insulative housing (10), a number of contacts (21, 22) and a bolt/nut device. The insulative housing includes a top wall (13), a bottom wall (14) opposite to the top wall, side walls (101, 102) connecting to the top and the bottom walls, a number of grooves (111, 112) extending through the bottom wall, a receiving cavity (15) defined at a bottom end of the insulative housing, and a latch (16) formed at the bottom end of the housing and extending partially into the receiving cavity. The contacts are received in the grooves of the insulative housing. The bolt/nut device includes a bolt (50) and a nut (40). The nut is received in the receiving cavity and engaged with the latch. The bolt is engageable with the nut from the bottom wall of the housing.

2 Claims, 7 Drawing Sheets

ELECTRICAL CONNECTOR HAVING RETENTION SYSTEM

BACKGROUND OF THE INVENTION

1. Field of the Invention

The present invention relates to an electrical connector, and more particularly to an electrical connector having a retention system for retaining the electrical connector on a printed circuit board.

2. Description of the Related Art

It is well known to provide an electrical connector mountable to a printed circuit board (hereinafter PCB), wherein the connector has terminals electrically engaging with respective electrical circuit traces on the PCB. Such a connector has a problem that the electrical connections between the terminals and the circuit traces of the PCB are often subjected to external stresses, which sometimes will cause the connections break. To resolve the problem, board locking mechanisms have been introduced in.

U.S. Pat. No. 5,249,983 (the '983 patent) and U.S. Pat. No. 5,228,873 (the '873 patent) each discloses a connector having bolt/nut devices for retaining the connector to a PCB, thereby securing the electrical connections between terminals of the connector and circuit traces of the PCB. Referring to FIGS. 1 to 3B of the '983 patent, the connector comprises a dielectric housing 1. The housing 1 defines a pair of nut-placing recesses 6 in a top wall thereof and a pair of bolt-inserting apertures 11 extending through a bottom wall thereof and communicating to respective recesses 6. A nut 13 is interferentially fitted in each recess 6. Once the connector is placed onto a PCB 17 with through holes 18 corresponding to the apertures 11, a bolt 20 is inserted in each through hole 18 and through respective aperture 11 along a bottom-to-top direction, and then screwed into the nut 13. It is noted that each nut-placing recess 6 is further formed with extended projections 10 on an internal surface thereof to interfere with the nut for retaining the nut therein.

However, when the nuts 13 are assembled into the recesses 6, additional tools have to be used. Furthermore, in order to secure the nuts 13 in the recesses 6, a close tolerance is required between the nuts and the projections 10 of the recesses. As a result, requirements for accuracy of the projections are tremendous high which inevitably increases the whole cost of the connector. For example, if the size of each projection of the recess is a little larger than a standard size, the nut could not be fitted in the recess, and if the size of each projection is a little smaller than the standard size, the nut could not be secured in the recess and would be pushed out as the bolt 20 intents to engage with the nut.

Taiwan patent issue No. 517885 having the same inventor and the same assignee with the invention, discloses a connector having a downward type retaining means for nuts. As is shown in FIGS. 2 and 4 of the 517885 patent, the connector comprises a housing 10. The housing 10 has a pair of mounting portions 12 at opposite ends thereof. Each mounting portion 12 includes a latch 16 formed in a top wall thereof and having a protrusion 160 projecting from a distal end of the latch, a mounting hole 123 extending therethrough, and a receiving cavity 121 corresponding to the latch 16 and communicating to the mounting hole 123. A nut 40 is assembled into the receiving cavity 121 from a side wall of the mounting portion 12 and engages with the protrusion 160 of the latch 16 to be prevented moving out of the cavity 121. When a bolt (not shown) is screwed into the nut 40, the nut abuts against the latch 16 and the housing 10.

By this way, the nut can be assembled into the receiving cavity without additional tools being used, and a loose tolerance is allowable between the nut and the receiving cavity/the latch, thereby requirements for accuracy of the receiving cavity and the latch are relatively lower because there is no interference between the nut and the receiving space to prevent the nut moving upwardly.

Since the latch and the receiving cavity are formed on a top end of the housing, the bolt requires a long length to extend through the PCB and the housing to engage with the nut. Such board locking mechanism is not adapted for a high profile connector, because a longer bolt is required, which is impractical and neither manufacture nor cost efficient. In addition, if the housing has other structures at the top end thereof, such latch and receiving cavity for nuts will result in increasing the size of the connector, which is obviously undersirable for designers with the ever-increasing miniaturization of electronic circuit.

Hence, an improved electrical connector is required to overcome the disadvantages of the prior art.

SUMMARY OF THE INVENTION

A major object of the present invention is to provide an electrical connector having a retention system which is both cost and space efficient.

In order to achieve the object set forth, an electrical connector comprises an insulative housing, a plurality of contacts and a bolt/nut device. The insulative housing comprises a top wall, a bottom wall opposite to the top wall, side walls connecting to the top and the bottom walls, a plurality of grooves extending through the bottom wall, a receiving cavity defined at a bottom end of the insulative housing, and a latch formed at the bottom end of the housing and extending partially into the receiving cavity. The contacts are received in the grooves of the insulative housing and each comprises a contacting portion and a tail portion extending from the contacting portion. The bolt/nut device comprise a bolt and a nut. The nut is received in the receiving cavity and engaged with the latch. The bolt is engageable with the nut from the bottom wall of the housing.

Other objects, advantages and novel features of the invention will become more apparent from the following detailed description when taken in conjunction with the accompanying drawings.

DETAILED DESCRIPTION OF THE INVENTION

Figure 1:
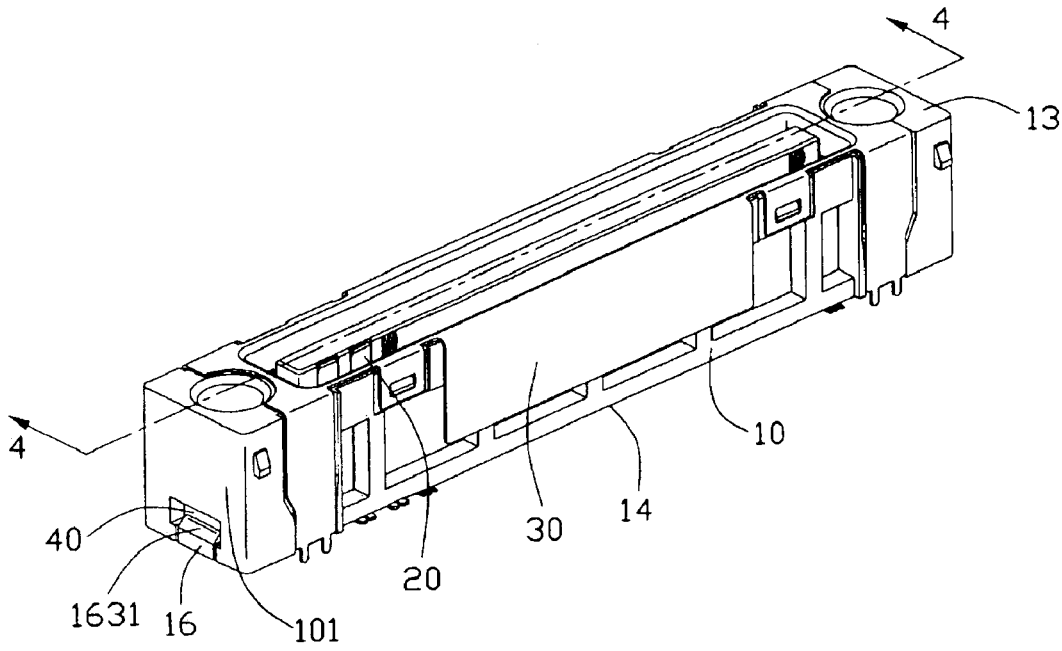
FIG. 1 is a perspective view of an electrical connector in accordance with the present invention, wherein bolts thereof are not assembled to nuts thereof.
Figure 2:
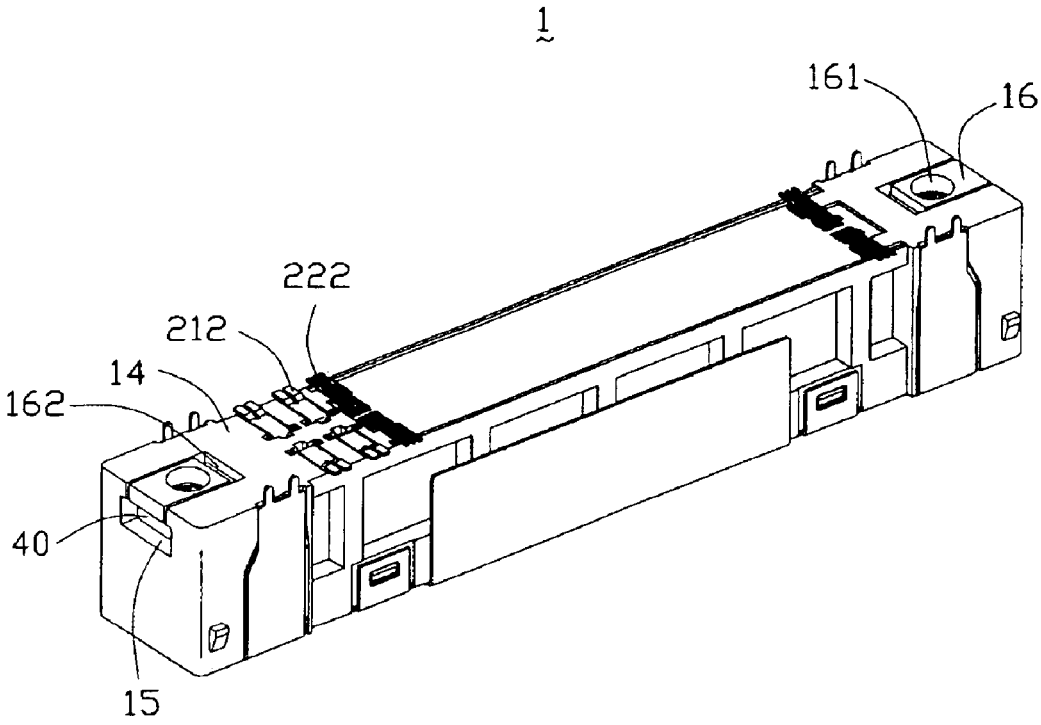
FIG. 2 is a view similar to FIG. 1 but taken from a different aspect.
Figure 3:
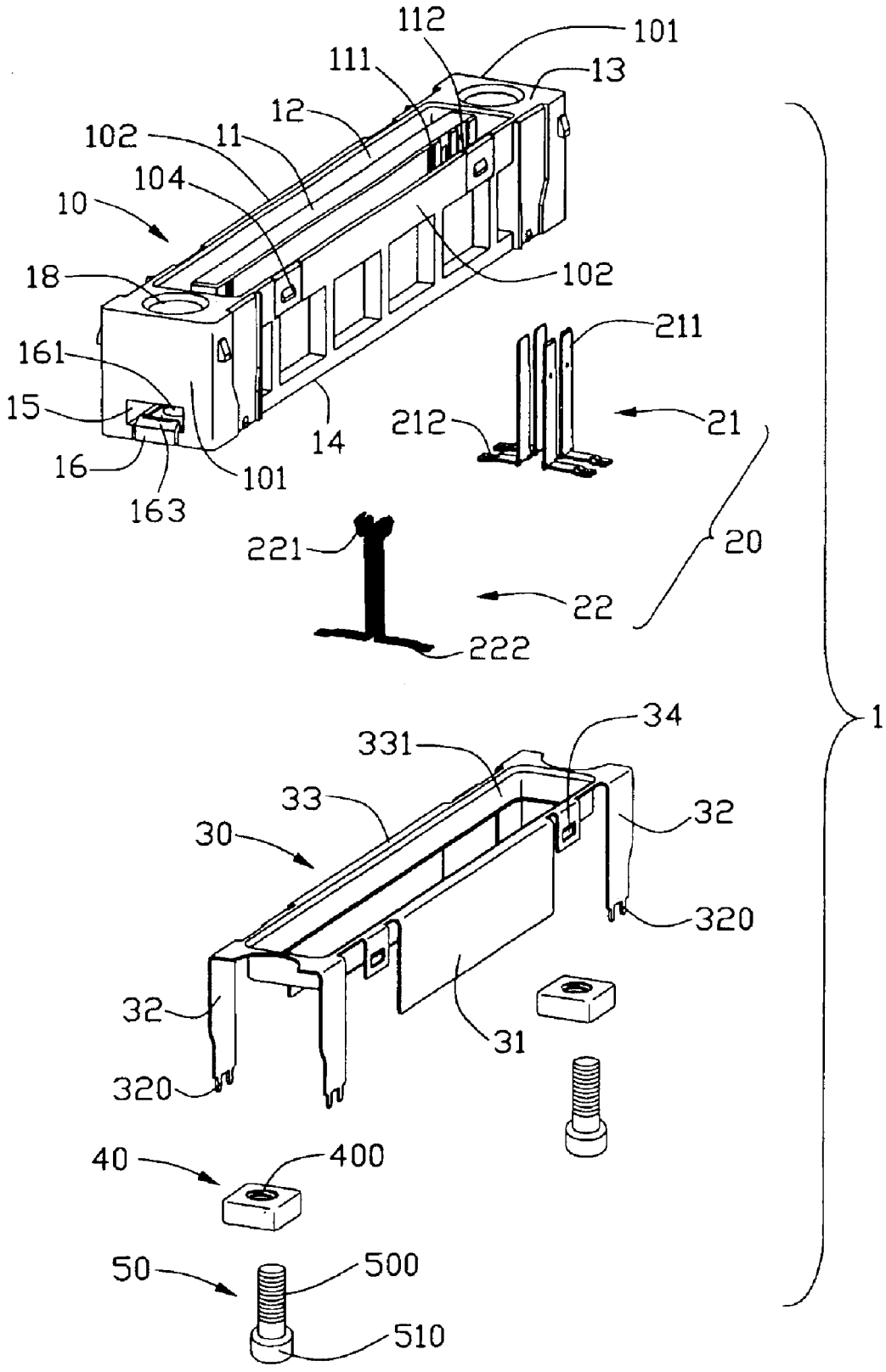
FIG. 3 is an exploded, perspective view of the electrical connector of FIG. 1.

Referring to FIGS. 1 to 3, an electrical connector 1 comprises an insulative housing 10, a plurality of contacts 20, a shell 30, and a pair of bolt/nut device. Referring to FIG. 3, the insulative housing 10 has a longitudinal configuration, which comprises a top wall 13, a bottom wall 14 (see FIG .2) opposite to the top wall 13, one pair of side walls 101 arranged in a longitudinal direction and connecting to the top and the bottom walls 13, 14, and another pair of side walls 102 arranged in a lateral direction and connecting to the top, bottom and side walls 13, 14, 101. The housing 10 defines a receiving space 12 opening at the top wall 13 for receiving a complementary connector (not shown), and a pair of guiding holes 18 opening at the top wall 13 and adjacent to opposite side walls 101 respectively for guiding the complementary connector therein. The housing 10 is formed with a tongue plate 11 projecting in the receiving space 12. The tongue plate 11 defines a plurality of grooves 111, 112 extending through the bottom wall 14 (see FIG. 2) on opposite sides thereof. In addition, the housing 10 is formed with a plurality of protrusions 104 on each side wall 102 thereof.

Figure 4:
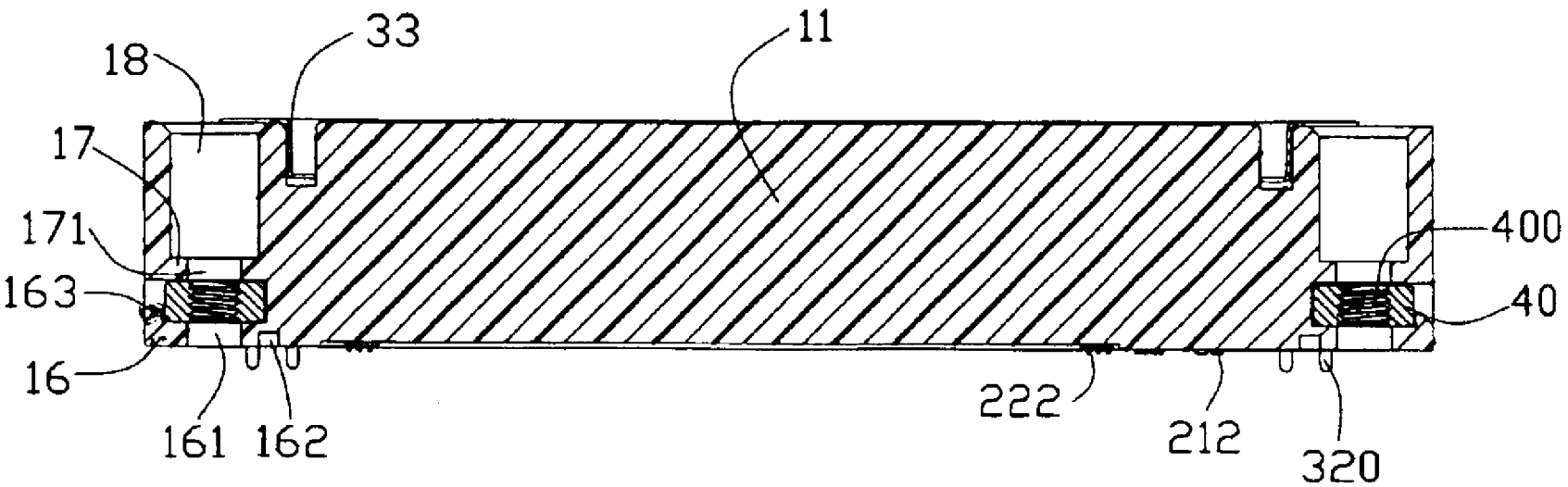
FIG. 4 is a cross-sectional view taken along line 4—4 of FIG. 1.

In conjunction with FIGS. 2 and 4, the insulative housing 10 comprises a pair of latches 16 formed in the bottom wall 14 each with a free end at respective side wall 101, a pair of receiving cavities 15 each corresponding to a latch 16 and opening at respective side wall 101, a pair of projecting loops 17 formed therein and each comparting a guiding hole 18 and a corresponding receiving cavity 15, and a pair of through holes 171 defined in the projecting loops 17 respectively. Each latch 16 comprises a projection 163 projecting from the free end of the latch 16 and into the receiving cavity 15, and an opening 161 extending therethrough and communicating with the receiving cavity 15. The projection 163 has an oblique face 1631 at an out end thereof for functioning as a guiding means. Furthermore, the insulative housing 10 defines a pair of slits 162 in the bottom wall 14 near ends of the latches 16 opposite to the free ends respectively to make each latch 16 achieve a high elastic capability. In this embodiment, the slit 162 extends through the bottom wall by two sides of the latch 16 so as to make superior elasticity of the latch 16.

The contacts 20 include two groups of contacts 21 and 22 that are respectively received in the grooves 111 and 112 of the tongue plate 11. Each contact 21 (22) includes a contacting portion 211 (221) and a tail portion 212 (222) extending from the contacting portion 211 (221).

The shell 30 is stamped from a metallic sheet. The shell 30 comprises a frame portion 33 with two opposite side walls 331, two opposite abutting portions 31 extending downwardly from opposite side walls 331 respectively, two opposite pairs of locking tabs 34 extending downwardly from opposite side walls 331 respectively, and two opposite pairs of leg portions 32 extending downwardly form the side walls 331 respectively. Each pair of locking tabs 34 is beside opposite ends of each abutting portion 31. Each pair of leg portions 32 is located at opposite ends of each side wall 331. Each leg portion 32 further includes a pair of grounding feet 320 extending downwardly from a bottom end thereof.

Figure 5:
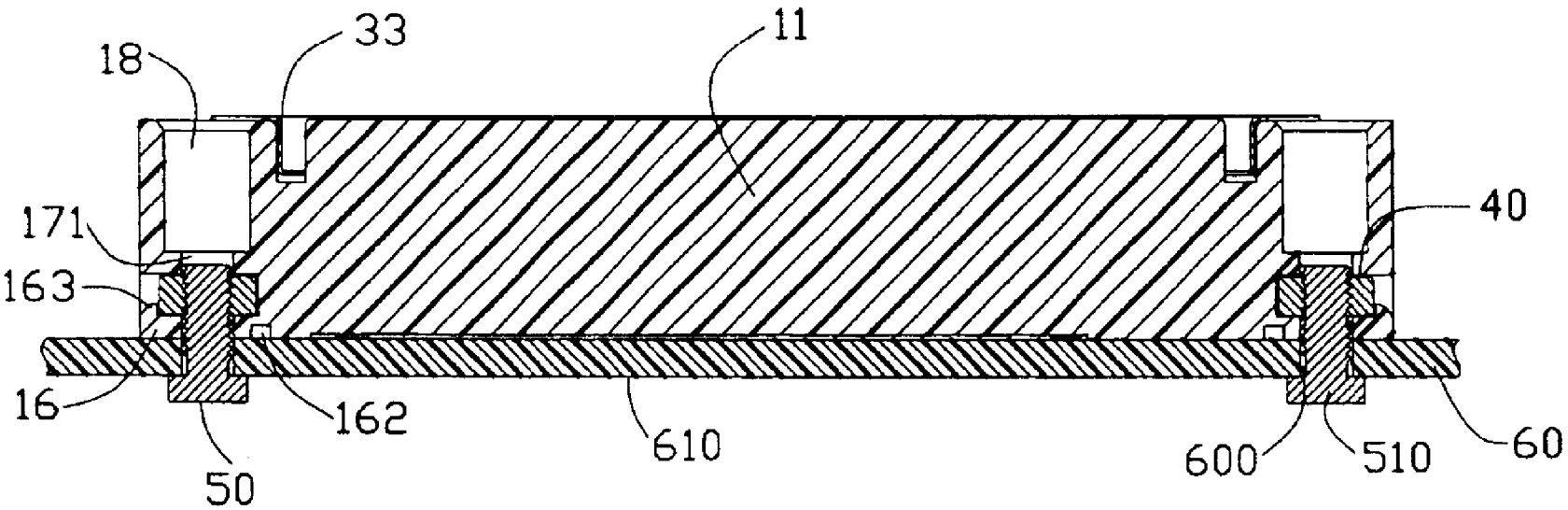
FIG. 5 is a cross-sectional view similar to FIG. 4, wherein the electrical connector is mounted on a PCB, and the bolts are assembled to the nuts.

Referring to FIG. 3, the pair of bolt/nut devices are used to secure the connector 1 on a PCB 6 (see FIG. 5). Each bolt/nut device comprises a bolt 50 and a nut 40. Each bolt 50 has a threaded portion 500 and a head portion 510 connecting to the threaded portion 510. Each nut 40 has a screw hole 400 therein for receiving the threaded portion 500 of the bolt 50.

Referring to FIGS. 3 and 4, in assembly, the contacts 21 and 22 are respectively inserted into the grooves 111 and 112 of the tongue plate 11 from the bottom wall 14 of the housing 10. The shell 30 is assembled to the housing 10 along a top-to-bottom direction. The abutting portions 31 and the leg portions 32 abut against the side walls 102 of the housing 10. The locking tabs 34 engage with the protrusions 104 of the housing 10. The nut 40 is inserted into the receiving cavity 15 by pressing against the guiding surface 1631 of the protection 163 to deform the latch 16 downwardly. After the nut 40 entering the cavity 15, the projection 163 of the latch 16 abuts against the nut 40 with a loose tolerance therebetween for preventing the nut 40 moving out of the receiving cavity 15. The screw hole 400 of the nut 40 and the opening 161 of the latch 16 and the through hole 171 align with each other in a vertical direction.

In conjunction with FIG. 5, the connector 1 together with the nut 40 is mounted onto the PCB 60 having a plurality of mounting holes 600 therein. The tail portions 212, 222 of the contacts 21, 22 are soldered to electrical circuit traces (not shown) of the PCB 60. The grounding feet 320 of the shell 30 are inserted in holes (not shown) of the PCB 60 and connect to grounding circuit traces (not shown) of the PCB 60. The bolt 50 is inserted into the mounting hole 600 from a bottom surface 610 of the PCB 60 and through the opening 161 of the latch 16 and finally screwed in the screw hole 400 of the nut 40. During the period of the bolt 50 being engaged with the nut 40, the nut abuts against the projecting loop 17 of the housing 10. As the bolt 50 is completely assembled to the nut 40, an end of the threaded portion 500 extends into the through hole 171, and the head portion 510 of the bolt 50 abuts tightly against the bottom surface 610 of PCB 60, and the nut 40 abuts tightly against the latch 16. Thus, the connector 1 is secured on the PCB 60.

In the present invention, the nut 40 is attached to the housing 10 at a position most adjacent to the PCB 60, thereby, the bolt 50 engaged with the nut 40 is not restricted by a height of connector 1 and just requires a very short length, which will make cost reduced. In addition, since the guiding hole 18 is defined on top end of the housing 10, the latch 16 for retaining the nut 40 being formed in the bottom wall 14 of the housing 10 can avoid increasing size in the longitudinal direction of the housing 10, which will result in space efficient.

Although the present invention has been described with reference to the preferred embodiments thereof, it is apparent to those skilled in the art that the latch can be formed in the housing at other positions. For example, the latch 16 is formed in the bottom wall 14 with the free end thereof locating at the side wall 102, or the latch 16 is formed in one side wall 101 (102) adjacent to the bottom wall 14 with the free end thereof locating at another side wall 102 (101). Under the latter condition, the housing further defines an opening communicating to the receiving cavity in the bottom wall for being extended through by the bolt.

One feature of the invention is to provide a new method of making the latch during an injection molding process, and particularly to form a so-called inner latch which inwardly faces a confined cavity. Understandably, each of most latches defines a projection for engagement with a piece which is intended to be locked. Conventionally, in the injection molding the projection should be made via two opposite molds to respectively form opposite inner and outer faces of the projection if those two opposite main molds is moveable along a lengthwise direction of the latch. Alternatively, an additional slide mold which is moved along a lateral direction perpendicular to the lengthwise direction of the latch, may be used to form at least one of the opposite inner and outer faces of the projection. In either aforementioned condition, the moving path of the molds, regardless of whether they are the main molds or the auxiliary slide mold, designedly should not interfere with, i.e., be obstructed by, the formed projection of the latch. In other words, conventionally the latch is not deflected and the projection of the latch is not moved during the molds departing from the molded latch.

Figure 6:
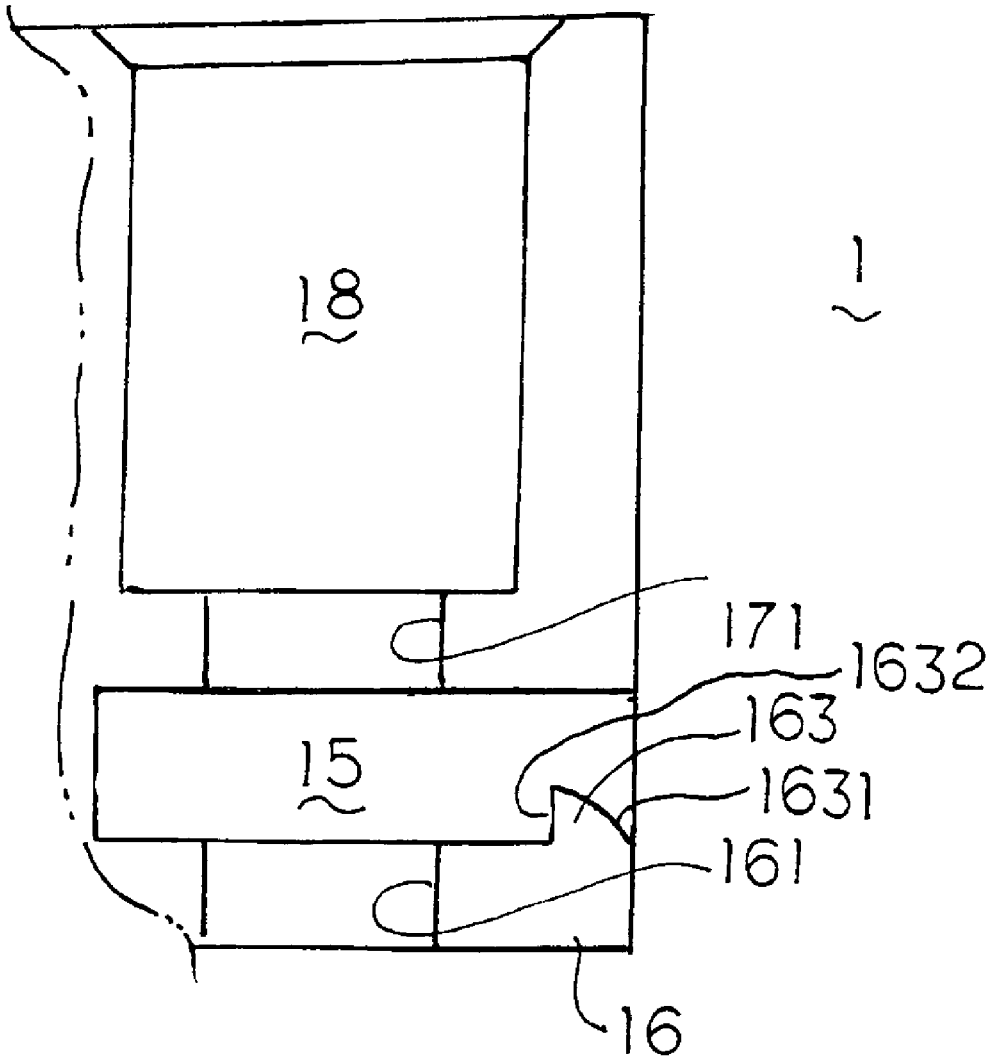
FIG. 6 is an enlarged illustrative partial view taken along line 4—4 without the nut therein to show the receiving cavity, the through hole and the opening corresponding to the bolt, and the latch beside said receiving cavity.
Figure 6B:
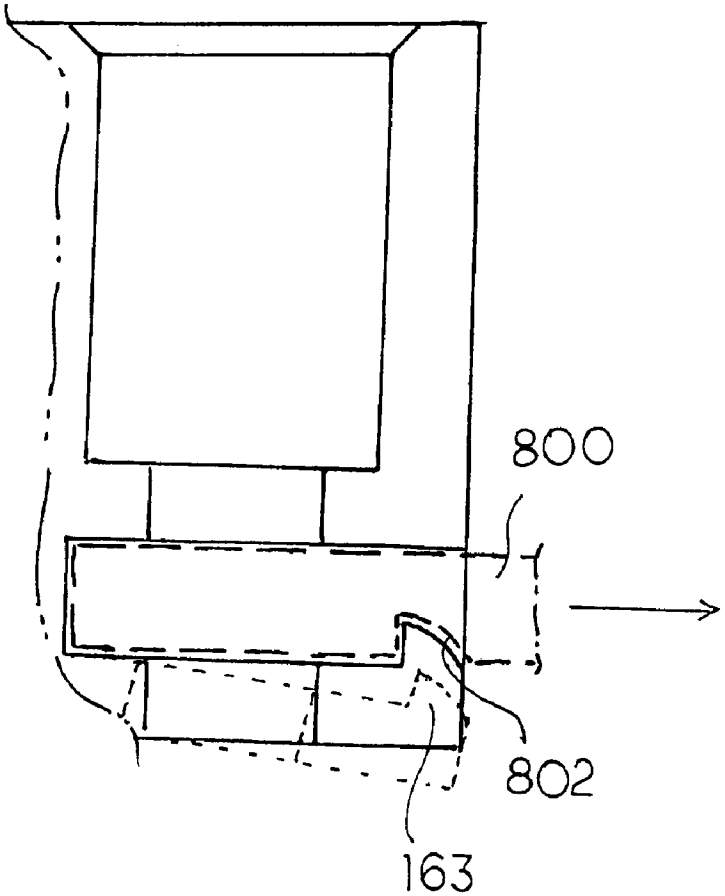
FIG. 6B is an enlarged illustrative partial view of FIG. 6 with the associated slide mold adapted to be withdrawn under deflection of the latch.
Figure 6A:
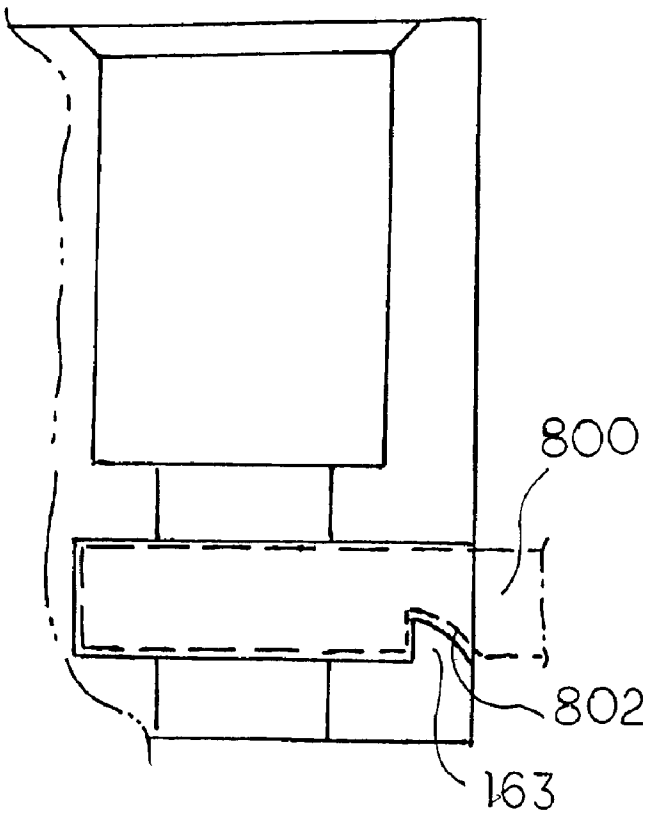
FIG. 6A is an enlarged illustrative partial view of FIG. 6 with the associated slide mold.

Differently, referring to FIGS. 6, 6A and 6B, in the invention because the locking projection 163 of the latch 16 faces inwardly to the receiving cavity 15 along the lengthwise direction and no proper mold is available to form the inner face 1632 of the projection 163, either along the lengthwise direction or the lateral direction, only a mold 800 equipped with a notch 802 configured to compliantly form the corresponding projection 163 and being moveable along the lengthwise direction, is used to form the projection 163 of the latch 16, wherein the formed latch 16 is required to be able to be downwardly deflected to have the projection 163 downwardly escape from the receiving cavity 15 for not improperly blocking the path of the slide mold 800 so that the slide mold 800 may be withdrawn outwardly along the lengthwise direction after the injection molding. The instant method allows to form the so-called inner projection of the latch, including the inner face and the outer face of the projection, around a confined receiving cavity by a one-piece mold moveable along a lengthwise direction of the latch which is perpendicular to the deflection direction of the latch, wherein generally such an inner projection is essentially infeasible/impossible in the conventional method which uses the non-interference withdrawal way between the mold and the projection of the latch because the inner face of the inner projection is designed not to communicate with the exterior in any direction. In brief, the instant invention adopts the new way to have the deflectable latch deflected, either actively or passively, during removal of the mold without improper obstruction so as to be able to form such a confined inner face of the projection of the latch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a top wall, a bottom wall opposite to the top wall, side walls connecting to the top and the bottom walls, a plurality of grooves extending through the bottom wall, a receiving cavity defined adjacent to the bottom wall and opened in one of the side walls, and a deflectable latch provided with a free end located at the side wall where the receiving cavity is opened and a projection projecting from the free end into the receiving cavity;

a plurality of contacts being received in the grooves of the insulative housing and each comprising a contacting portion and a tail portion extending from the contacting portion; and a screw nut with a screw hole therein received in the receiving cavity;

further comprising a bolt being screwable with the nut; wherein the housing defines a slit in the bottom wall near an end of the latch opposite to the free end for enhancing the elastic capability of the latch; wherein the latch is formed in the bottom wall and defines an hole aligning with the screw hole of the screw nut; wherein the insulative housing is formed with a projecting loop therein abutted by the nut; wherein the insulative housing is formed with a tongue plate therein, and wherein the grooves are defined on the tongue plate; wherein the insulative housing defines a guiding hole beside the tongue plate.

2. The electrical connector as claimed in claim 1, further comprising a shell covering the housing and comprising a frame portion and a leg portion is formed with a grounding foot extending therefrom.

* * * * *